US008262355B2

(12) United States Patent
Kopmels

(10) Patent No.: US 8,262,355 B2
(45) Date of Patent: Sep. 11, 2012

(54) COOLED COMPONENT

(75) Inventor: Michiel Kopmels, Bristol (GB)

(73) Assignee: Rolls-Royce PLC, London (GB)

( * ) Notice: Subject to any disclaimer, the term of this patent is extended or adjusted under 35 U.S.C. 154(b) by 771 days.

(21) Appl. No.: 12/230,159

(22) Filed: Aug. 25, 2008

(65) Prior Publication Data

US 2009/0060715 A1 Mar. 5, 2009

(30) Foreign Application Priority Data

Sep. 1, 2007 (GB) ..... 0717028.5

(51) Int. Cl.
*F01D 5/18* (2006.01)

(52) U.S. Cl. ..... 416/96 R; 415/115; 416/96 A

(58) Field of Classification Search ..... 416/96 R, 416/97 R, 224, 226; 415/115
See application file for complete search history.

(56) References Cited

U.S. PATENT DOCUMENTS 7,527,474 B1 * 5/2009 Liang ..... 416/1

FOREIGN PATENT DOCUMENTS

| | | | |
|---|---|---|---|
| EP | 0 230 917 | A2 | 8/1987 |
| EP | 1 380 724 | A2 | 1/2004 |
| EP | 1 793 085 | A2 | 6/2007 |
| EP | 1 788 195 | A2 | 5/2008 |
| WO | WO 2007/094212 | A1 | 8/2007 |

* cited by examiner

*Primary Examiner* — Kiesha Bryant
*Assistant Examiner* — Abbigale Boyle
(74) *Attorney, Agent, or Firm* — Oliff & Berridge, PLC

(57) ABSTRACT

A component, such as a turbine blade of a gas turbine engine, has an internal cooling system which includes a passage (28) having a passage inlet (22) and a passage exit (30), which may be in the form of passageways at or adjacent to the trailing edge of the component. The passage (28) is divided into chambers (52, 54, 56, 58) by partitions (40, 42, 44) which extend from one wall (34) of the component and terminate short of the opposite wall (36) to provide gaps (46, 48, 50) to permit chord-wise cooling air flow from the passage inlet (22) to the passage exit (30). The gaps (46, 48, 50) force the cooling air to pass adjacent the hot walls (34, 36), so increasing the heat transfer coefficient between the cooling air and the material of the component.

30 Claims, 5 Drawing Sheets

View on II-II, Fig 1

View on IV-IV, Fig 3

View on VI-VI, Fig 5

COOLED COMPONENT

This invention relates to a cooled component, and is particularly, although not exclusively, concerned with such a component in the form of an aerofoil component, such as a turbine blade or nozzle guide vane of a gas turbine engine.

The performance of the simple gas turbine cycle, whether measured in terms of efficiency or specific output, is improved by increasing the turbine gas temperature. It is therefore desirable to operate the turbine at the highest possible temperature.

The trend in both military and civil gas turbine engines has been towards turbofan engines having compact, high temperature gas generators. For any engine cycle compression ratio or bypass ratio, increasing the turbine entry gas temperature will always produces more specific thrust (eg engine thrust per unit of air mass flow). However as turbine entry temperatures are increased, the life of an uncooled turbine falls, necessitating the development of better materials and the introduction of internal air cooling for the components of the turbine. In modern engines, the high pressure (HP) turbine gas temperatures are much hotter than the melting point of the materials from which the turbine components are made. Some intermediate pressure (IP) and low pressure (LP) turbines are also cooled.

The mean temperature of the gas stream decreases as power is extracted during its journey through the turbine. Therefore the need to cool decreases as the gas moves from the HP stage(s) to the exit nozzle. HP nozzle guide vanes (NGVs) consume the most amount of cooling air on high temperature engines. HP blades typically use half of the NGV cooling flow. Stages downstream of the HP turbine use progressively less cooling air.

Blades and vanes are cooled by using high pressure air from the compressor that has by-passed the combustor and is therefore relatively cool compared to the working gas flowing through the turbine. Typically cooling air temperatures are between 700K and 900K. Gas temperatures can be in excess of 2100K. Internal convection and external films are the prime methods of cooling the aerofoils.

The cooling air from the compressor that is used to cool the hot turbine components is not used fully to extract work from the turbine. Extracting air for the cooling therefore has an adverse effect on the engine operating efficiently. It is thus important to use this cooling air as effectively as possible.

So-called multipass arrangements have been used to achieve cooling ducts that are long in relation to their cross-section. In a multipass arrangement, a cooling duct typically has a serpentine configuration, extending radially outwardly from a cooling air inlet, then undergoing one or more reverse bends so that the cooling air flows several times along the length of the component in opposite radial directions.

The radial sections of the duct extend from near the leading edge of the component progressively towards the trailing edge. There are particular difficulties in cooling the trailing edge adequately, and the section of the duct nearest the trailing edge may have ribs which extend chordwise (ie transversely of the duct sections) to generate turbulence in the flow to enhance the heat transfer coefficient.

Alternative arrangements are used that pass the flow within the component in a chord-wise sense. Heat transfer can be enhanced using pedestals. Nevertheless, chord-wise flow has the disadvantage that the length of the duct is relatively short in relation to the flow cross-section by comparison with radial multipass arrangements.

Pedestals are subject to manufacturing constraint because the pedestals have to have fillets and they have a minimum diameter. The weight of the pedestals is parasitic, that is to say that they increase the weight of the component and need to be supported by the main aerofoil structure, but they are not themselves load bearing.

An acceptable heat transfer enhancement is generally only possible where the flow Reynolds number is reasonably high. This requires the passage to be generally thin or the number of pedestals to be high. As the number of pedestals increases, the spaces between them become smaller, and so the system becomes more prone to sand blockage.

Blades exhibiting radially flowing multipass systems generally suffer from pressure losses at the bends that make it difficult to achieve increased cooling air flow rate. Also, heat is picked up all along the radial duct sections, so that the coolant temperature rises as it progresses along the duct. Towards the end of the duct, the cooling air may be too hot to extract significant heat from the metal of the component. This is typically the reason why this region, ie the trailing edge region of the component, suffers from thermal distress and oxidation.

EP 1788195 discloses a blade for a gas turbine engine having a multipass cooling arrangement. At the radially outer region of the blade, provision is made for cooling air to pass directly from a first section of the cooling duct to a trailing edge section, bypassing an intermediate section. In the bypass region, support members are provided to transfer centrifugal loads from an internal wall member of the blade to a shroud at the radially outer end. In addition, stub members are provided which extend partly across the hollow interior of the aerofoil to disrupt cooling air as it flows from the first duct section to the trailing edge section.

According to the present invention there is provided a component having oppositely disposed external walls defining an internal passage of the component for conveying cooling fluid, the passage extending from a passage inlet to a passage exit and having a plurality of chambers which are separated by at least one partition, the partition extends internally from one of the walls towards an internal surface of the opposite wall and terminates short of the internal surface of the opposite wall to provide a gap, the chambers communicating with each other through the gap wherein the partition has a lateral extension at its end to increase the length of the gap.

The provision of lateral extensions on the partitions increases the length of the gaps thereby increasing the contact time between the respective walls and the cooling air flow through the gaps.

The lateral extensions may extend to either one side only of the respective partition or to both sides.

There may be at least three of the chambers, and at least two of the partitions separating the respective chambers from one another. The partitions may extend in opposite directions from each other into the passage from respective opposite walls. Alternatively the partitions may include at least two adjacent partitions which extend from the same wall.

The gaps may have different widths from one another. For example, an upstream one of the gaps, with respect to the flow direction through the passage from the passage inlet to the passage exit, may have a smaller width than a downstream one of the gaps.

At least one outlet passageway may be provided in one of the walls to enable cooling fluid to pass from one or more of the chambers to the exterior of the component.

The lateral projection and the internal surface region of the respective wall may be parallel to one another so that the gap has a constant width over its length in the flow direction.

The cooling fluid passage may have a serpentine configuration, to increase the overall length of the cooling fluid duct within the component, thereby enhancing heat transfer from the component to a cooling fluid flowing within the cooling fluid duct.

The component may be an elongate component and the chambers may also be elongate, and may extend in the lengthwise direction of the component, for example over substantially the full length of the component.

The component may be an aerofoil component of a gas turbine engine, for example a component of a turbine stage of the engine, such as a nozzle guide vane or a turbine blade. Where the component is an aerofoil component, the passage exit may comprise exit passageways opening to the exterior of the component adjacent to the trailing edge of the component.

For a better understanding of the present invention, and to show how it may be carried into effect, reference will now be made, by way of example, to the accompanying drawings, in which.

Figure 1:
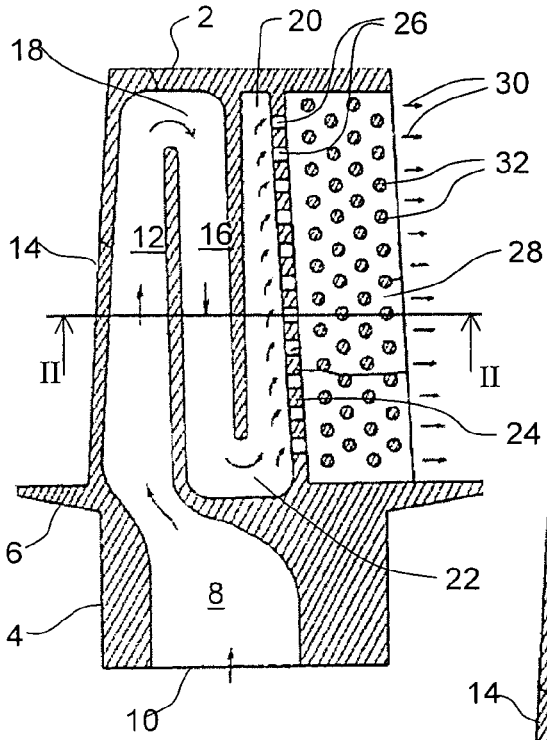
Fig 1 Prior Art
FIG. 1 is a longitudinal sectional view of a known turbine blade.
Figure 3:
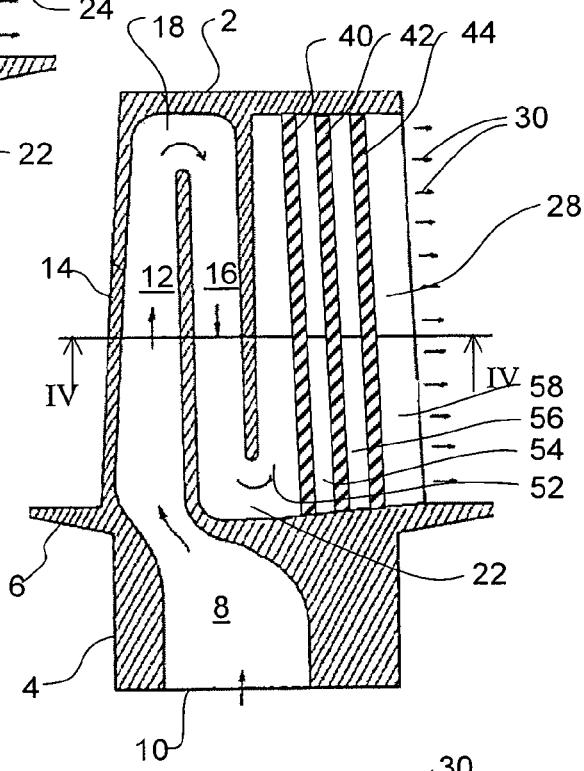
Figure 4:
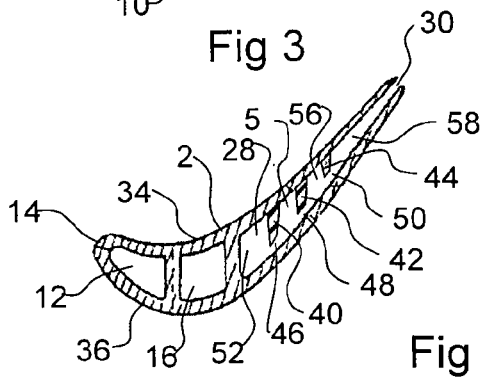
Figure 5:
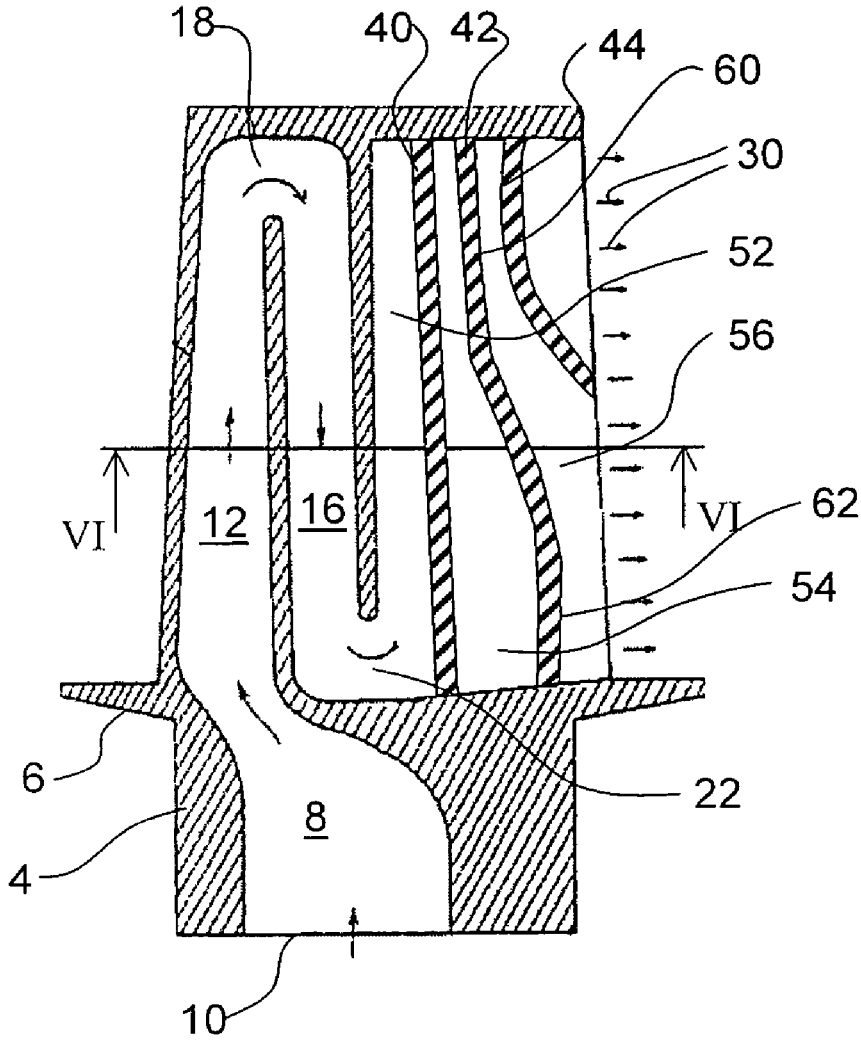
Figure 6:
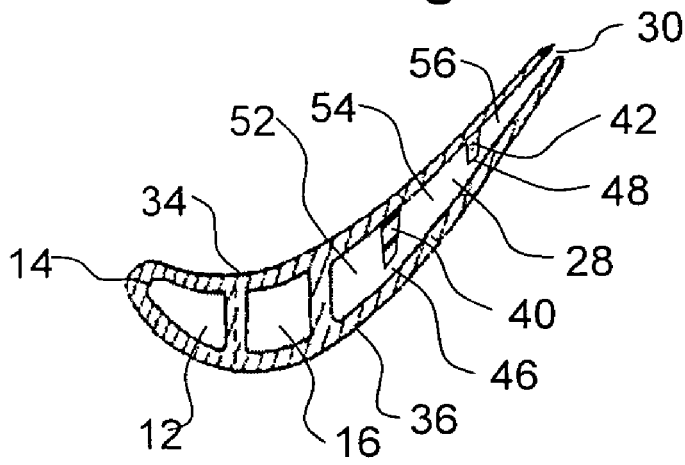
Figure 7:
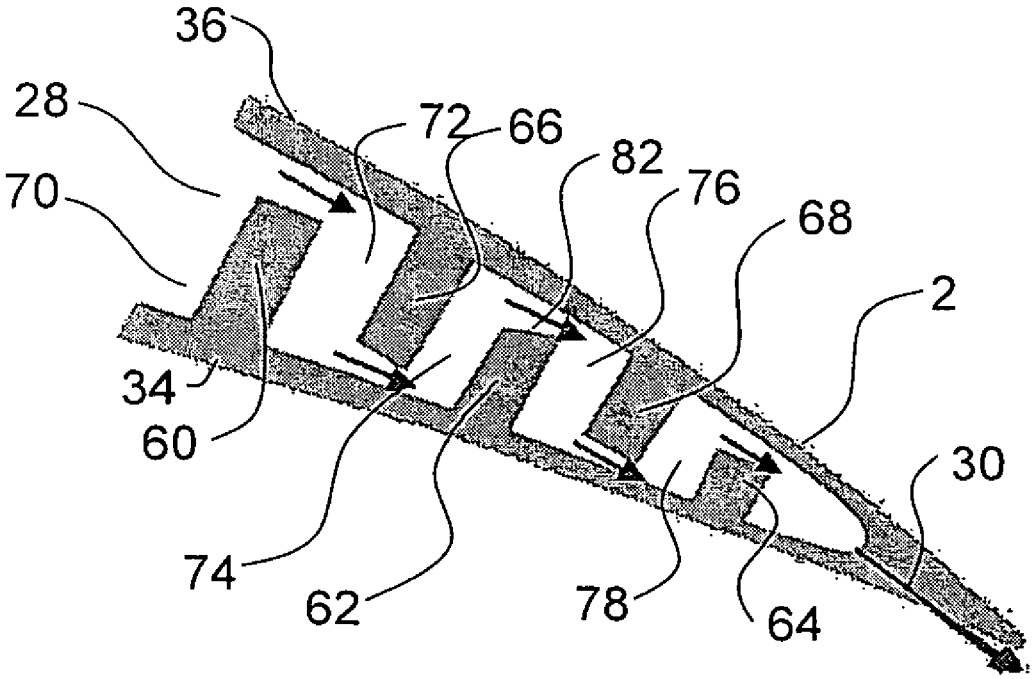
Figure 10:
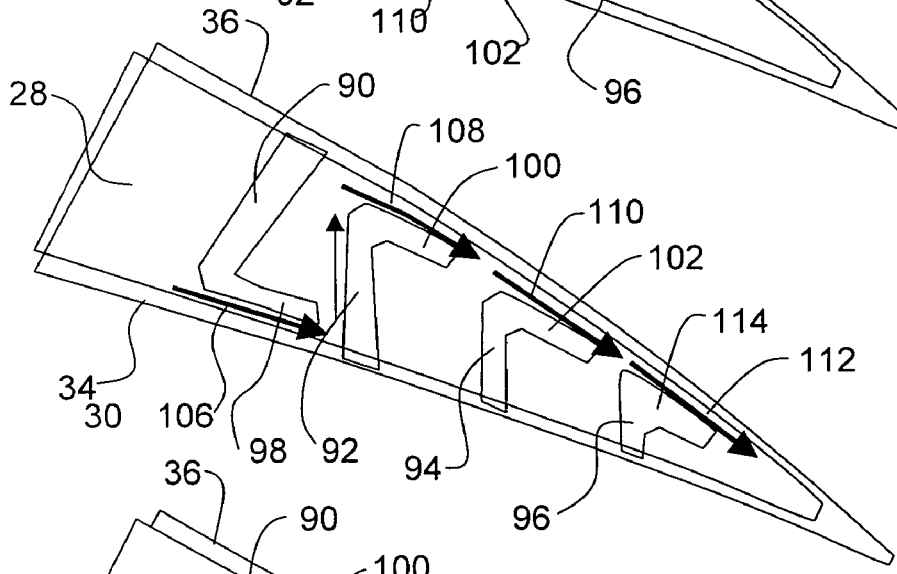
Figure 11:
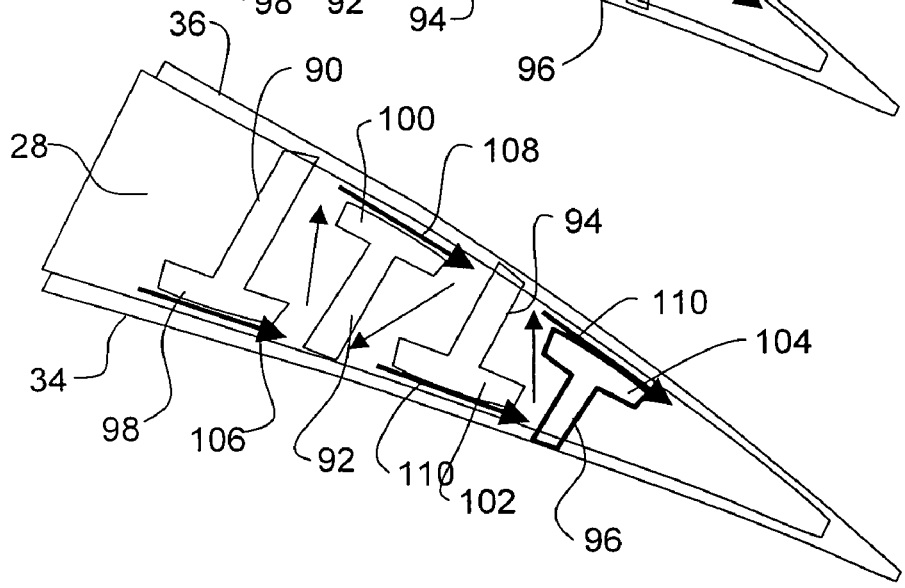
Figure 12:
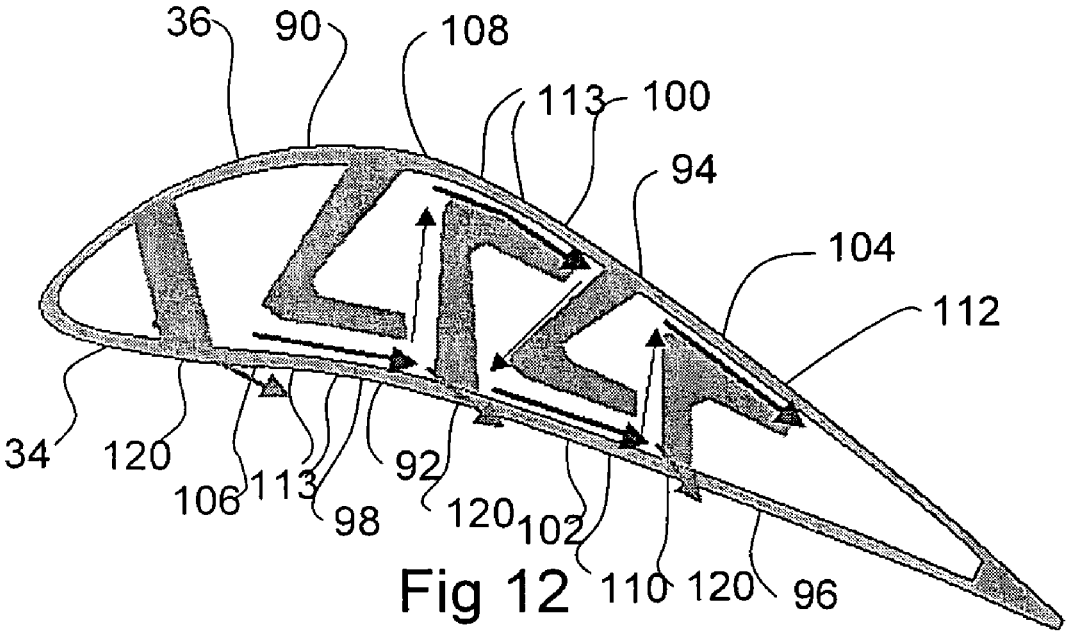
Figure 13:
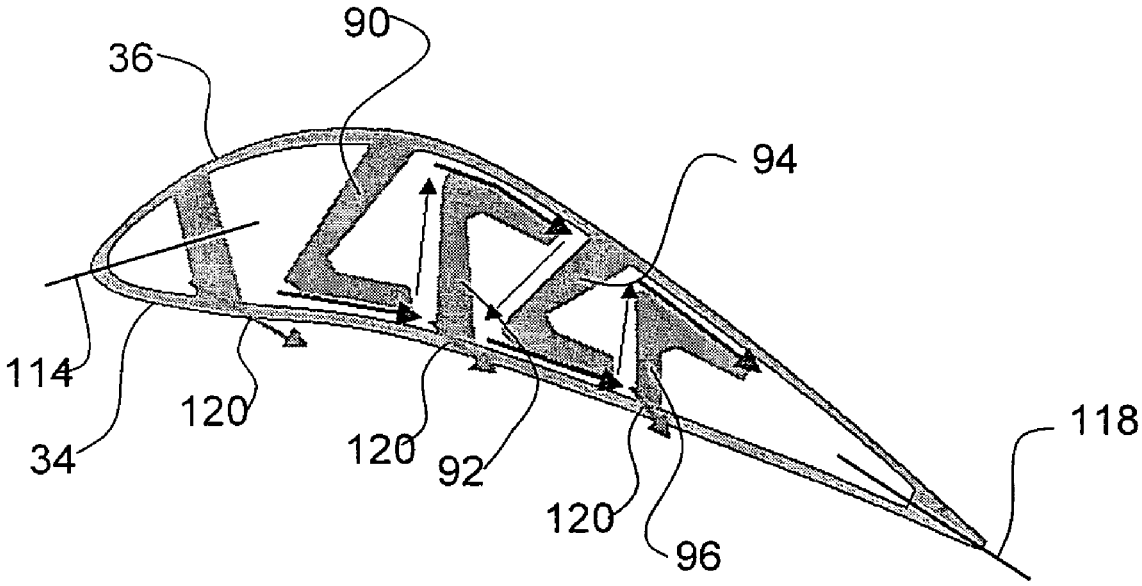

FIG. 3 corresponds to FIG. 1 but shows a turbine blade in accordance with the present invention;

FIG. 4 is a transverse sectional view taken on the line IV-IV in FIG. 3;

FIG. 5 corresponds to FIG. 4 but shows an alternative configuration;

FIG. 6 is a transverse sectional view taken on the line VI-VI in FIG. 5;

FIG. 7 is a partial transverse sectional view corresponding to FIG. 6, but showing an alternative embodiment;

FIGS. 8 to 11 correspond to FIG. 7 but show four further embodiments; and FIGS. 12 and 13 correspond to FIG. 4, but show two further embodiments.

Figure 2:
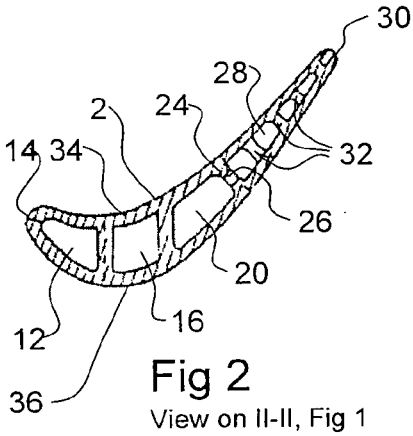
FIG. 2 is a transverse sectional view of the blade shown in FIG. 1, taken on the line II-II in FIG. 1.

The turbine blade shown in FIGS. 1 and 2 is a turbine blade of a gas turbine engine, and is made from an appropriate aerospace alloy. The blade comprises an aerofoil 2 having a root 4 and a platform 6. For use, the blade is attached to a turbine disk at the root 4. The platform 6 engages the platforms of adjacent blades on the disk to form a continuous circumferential platform.

The blade is internally cooled and to this end is provided with a serpentine cooling fluid duct 8 which extends from a cooling fluid inlet 10. In operation, cooling fluid, which is commonly air taken from a compressor stage of the gas turbine engine in which the blade is installed, enters the duct 8 through the inlet 10, which communicates with a passageway in the turbine disk. The duct has a first section 12 which extends radially outwardly of the aerofoil 2 adjacent its leading edge 14. The first section 12 is connected at the radially outer end region of the aerofoil 2 to a second section 16 at a reverse bend 18. The second section 16 is connected at the radially inner end of the aerofoil 2 to a third section 20 at a reverse bend 22.

The section 20 of the duct 8 is bounded on one side by a partition 24. The partition 24 is perforated by apertures 26 which enable air to flow from the section 20 into a passage 28 which communicates with the exterior of the blade through apertures or slots (not shown, but represented by arrows 30) at the trailing edge of the aerofoil 2.

Pedestals 32 extend across the passage 28 to provide structural rigidity and to induce turbulence in the flow of air through the passage 28.

It will be appreciated from FIG. 2 that the sections 12, 16, 20 of the duct 8, and the passage 28, are bounded by opposite walls 34, 36 of the aerofoil 2, the wall 34 providing the pressure surface of the aerofoil 2, and the wall 36 providing the suction surface. The width of the passage 28 extends substantially from the platform 6 to the radially outer end of the aerofoil 2.

In operation of an engine in which the turbine blade shown in FIGS. 1 and 2 is installed, cooling air, drawn from the engine compressor, is introduced to the duct 8 through the duct inlet 10. The air travels along the first, second and third sections 12, 16, 20 of the duct 8, taking heat from the material of the blade. From the duct section 20, the cooling air, now at a significantly higher temperature than at the inlet 10, passes through the apertures 26 into the passage 28. The air flows past the pedestals 32, picking up further heat as it goes, eventually emerging through the trailing edge apertures or slots 30.

Heat transfer from the material of the blade to the cooling air in the passage 28 is adversely affected by the relatively short length of the passage 28 (in the chord-wise general flow direction of the cooling air) in relation to the flow-cross section of the passage 28 (ie in a plane perpendicular to the general flow direction). Furthermore, the pedestals 32 have fillets at their ends, where the material is radiused at the transition between each pedestal 32 and the respective outer wall 34, 36 of the aerofoil 2. Heat transfer can be enhanced by packing more pedestals into the same volume, but this would lead to potential blockage of the cooling passage.

FIGS. 3 and 4 show a turbine blade in accordance with the present invention. The blade of FIGS. 3 and 4 is similar to that of FIGS. 1 and 2, but has a different configuration in the passage 28 in order to enhance heat transfer. Features of the blade shown in FIGS. 3 and 4 (and in the subsequent Figures) which are the same as corresponding features in FIGS. 1 and 2 are denoted by the same reference numbers.

It will be appreciated from FIG. 3 that the second section 16 of the duct 8 emerges into the chord-wise passage 28 at the reverse bend 22, which can be regarded as a passage inlet for the passage 28. The passage 28 is provided with three partitions 40, 42, 44 which are spaced apart in the chord-wise flow direction of cooling air along the passage 28. The partitions 40, 42, 44 extend from the outer wall 34 on the pressure side of the aerofoil 2, and stop short of the outer wall 36 on the suction side. The partitions 40, 42, 44 thus define, with the outer wall 36, respective gaps 46, 48, 50.

The partitions 40, 42, 44 divide the passage 28 into four chambers 52, 54, 56, 58 which communicate with one another through the gaps 46, 48, 50. The reverse bend 22 may be regarded as defining the inlet to the passage 28, thus, air flowing through the bend or passage inlet 22 initially reaches the first chamber 52 of the passage 28. The air flow then successively passes to the chambers 54, 56 and 58, eventually emerging to the exterior of the blade through the apertures or slots 30 at the trailing edge, which thus constitute passage exits from the passage 28.

The width of the gaps 46, 48, 50 is controlled to achieve a desired Reynolds number in the flow passing through them so as to enhance the heat transfer coefficient between the material of the suction side wall 36 and the cooling air flowing through the gaps 46, 48, 50 and the overall pressure drop.

In the embodiment shown in FIGS. 3 and 4, the partitions 40, 42 and 44, and consequently the chambers 52, 54, 56 and 58, are generally straight and extend longitudinally of the aerofoil 2 so that the heat transfer effect is generally consistent over the full length of the aerofoil 2. However, in some circumstances, it may be desirable to vary the heat transfer over the length of the aerofoil, for example to enhance heat transfer at regions of the aerofoil 2 which are particularly susceptible to overheating. Thus, for example, as shown in FIGS. 5 and 6, the partitions 40, 42, 44 may not all have a straight configuration. Instead, while the first rib 40 in the flow direction remains straight, the second rib 42 has a straight initial section 60 at the radially outer region of the aerofoil 2, followed by a displaced section 62 which is deflected in the downstream direction, with reference to the direction of flow through the passage 28. The third partition 44 extends radially inwardly from the outer end of the aerofoil 2, but is curved towards the downstream direction to meet the trailing edge in the region of the midpoint of the aerofoil 2 in the radial direction. Consequently, only the radially outer region of the aerofoil 2 is subjected to the cooling effect achieved by accelerating the air flow through three gaps between the partitions 40, 42 and 44 and the adjacent suction side outer wall 36. At the radially inner region of the aerofoil 2, only two such gaps 46, 48 are provided. Similarly, only the chambers 52 and 54 extend the full length of the aerofoil 2, with the third chamber 56 opening to the exterior through the passageways 30 at the radially inner region of the aerofoil 2, and the chamber 58 opening to the exterior only in the radially outer region of the aerofoil 2.

Considered from another viewpoint, in the described arrangement the partitions 40, 42, and 44 also have the effect of precipitating a pressure drop at the outer region of the aerofoil. Consequently, variations in disposition, orientation and spacing of the partitions and their interaction with the trailing edge boundary can be employed as means for producing a distribution of pressure loss along the length of the trailing edge, in other words along the span of the blade. This distribution of pressure drop at the trailing edge can be used to control the rate at which cooling flow is ejected from the trailing edge apertures.

In the embodiments of FIGS. 3 to 6, the partitions 40, 42, 44 all extend from the pressure side outer wall 34, so that the gaps 46, 48 and 50 extend at the suction side outer wall 36. However, it is desirable in some circumstances for the partitions to extend from both walls 34, 36, as shown in FIG. 7. In the embodiment of FIG. 7, the partitions project alternately from the pressure side outer wall 34 and the suction side outer wall 36, three partitions 60, 62, 64 extending from the outer wall 34, and two partitions 66, 68 extending from the outer wall 36. The passage 28 is divided by the partitions 60 to 68 into chambers 70, 72, 74, 76, 78 and 80. As the air flows from the first chamber 70 towards the passage exit constituted by the apertures or slots 30 at the trailing edge of the aerofoil 2, it is successively directed in opposite directions across the thickness of the aerofoil 2, so as to impinge alternately on the walls 34, 36 before passing through the gaps between the partitions 60 to 68 and the respective walls 34, 36.

It will also be noted from FIG. 7 that the end faces of the partitions 60 to 68 can be directed at different angles of inclination, with respect to the adjacent surface of the respective outer wall 34, 36, in order to achieve a desired profile along the length, in the flow direction, of the respective gap. For example, it will be noted that the end face 82 of the partition 62 is relatively sharply inclined with respect to the adjacent inner surface region of the suction side outer wall 36, so that the gap defined by the partition 62 has a strongly convergent shape in the flow direction (indicated by arrows) through the passage 28.

Figure 8:
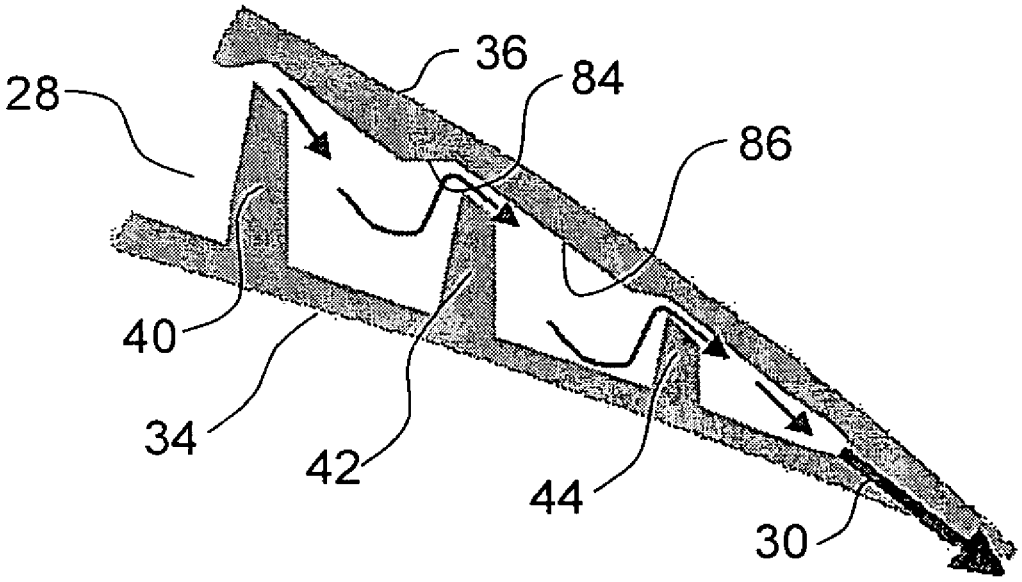

FIG. 8 shows a modified version of the structure shown in FIG. 4, in which the internal profile of the suction side outer wall 36 is configured in a generally saw-tooth fashion so that the thickness of the outer wall 36 varies in the direction of flow. Thus, adjacent each partition (and taking the partition 42 by way of example), the inner surface of the wall 36 has a first portion 84 which is directed away from the opposite wall 34 in the flow direction through the passage 28, and a second portion 86 which is directed towards the opposite wall 34. A projection of the surface portion 86 would intersect the next downstream partition 44. The end faces of the partitions 40, 42, 44 are oriented to be generally parallel to the respective second portions 86, although, as with the embodiment of FIG. 7, different gap profiles could be achieved by appropriate forming of the end faces of the partitions 40, 42, 44. The purpose of the thicker portion 84 is to direct the flow away form the passage 48 between partition 42 and outer wall 36, thereby increasing the pressure loss sustained by the coolant flow.

As a result of the configuration shown in FIG. 8, cooling air flow from each gap is directed away from the suction side wall 36 towards the pressure side wall 34. The flow must then be deflected sharply to reach the next downstream gap where it is, again, deflected towards the pressure side wall 34 by the respective surface portion 86.

Figure 9:
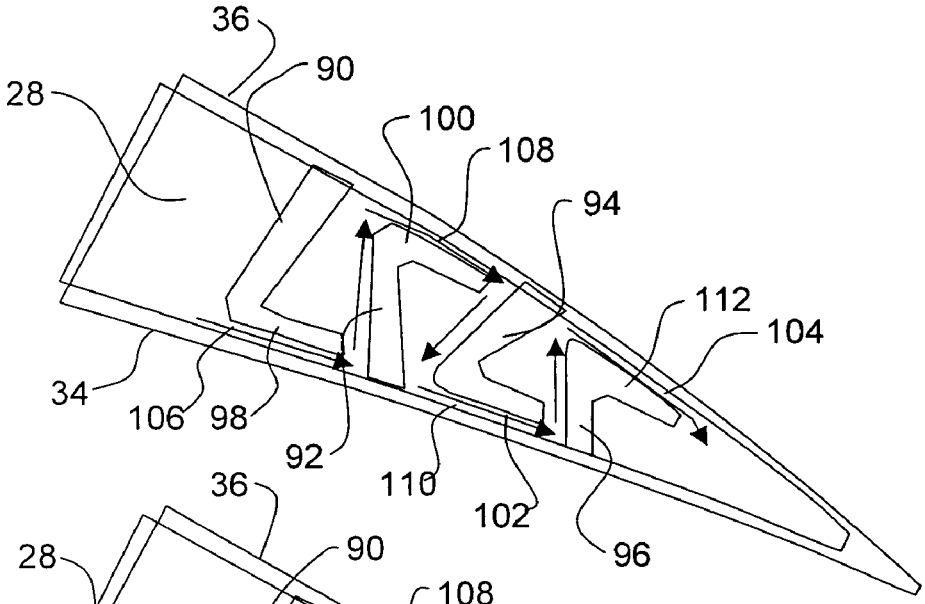

In the embodiments of FIGS. 9 to 11, the partitions, here designated 90, 92, 94, 96, are provided with lateral extensions 98, 100, 102, 104. These extensions increase the length of the gaps 106, 108, 110, 112, thereby increasing the contact between the respective walls 34, 36 and the cooling air flowing through the gaps. In the embodiments of FIGS. 9 and 10, the extensions 98 to 104 project to one side only of the respective partition 90 to 96. However, in the embodiment of FIG. 11, the extensions 98 to 104 project to both sides of the partitions 90 to 96.

In the embodiments of FIGS. 3 to 11, the passage 28 is provided in the trailing edge region of the aerofoil 2, and is supplied with cooling air which has already passed through the serpentine duct 8. In some embodiments, the passage 28 can extend over a greater chord-wise extent of the aerofoil 2, as shown in FIGS. 12 and 13. Referring first to FIG. 12, there is a cooling duct 8 extending over a single radially outwardly extending section from an inlet 10 (not shown). At the radially outer end of the aerofoil 2, the duct 8 communicates with the passage 28 at a passage inlet. Thereafter, the passage 28 has generally the configuration shown in any one of the preceding embodiments shown in FIGS. 3 to 11. By way of example, the partition structure represented in FIGS. 12 and 13 follow that shown in FIG. 9. However, to stabilise the partitions 90 to 96, either to control the size of the gap 106 to 112 or to enhance the structural integrity of the aerofoil, it may be desirable to provide support means, in the form of links 113, between the partitions 90 to 96 and the adjacent wall 34 or 36. Such links are shown for the partitions 90 and 92 in FIG. 12, and comprise elements formed integrally with both the partitions 90 and 92 (or more specifically their lateral extensions 98 and 100) and the adjacent wall 34 or 36. The links can be any suitable form to achieve the desired effect, for example they can have relatively small and circular, long and rectangular, horizontal, vertical or inclined.

Blades in accordance with FIGS. 3 to 12, or similar cooled components embodying the present invention, may be made using any suitable manufacturing technique. One possibility is to form the aerofoil as two separate sub-components which are subsequently joined together, for example by welding. Such a possibility is shown in FIG. 13. The pressure side wall 34 and the suction side wall 36, with the partitions that extend from them (ie the partitions 92, 96 extending from the pressure side wall 34 and the partitions 90, 94 extending from the suction side wall 36) are formed separately, possibly by an extrusion process, and subsequently joined together, for example by welding, at the joint lines 114, 118.

It will be appreciated that, as is known, film cooling of the external surfaces of the aerofoil can be achieved by bleeding a proportion of the cooling air from the interior of the aerofoil 2 to the exterior. This is indicted diagrammatically in FIGS. 12 and 13 by means of arrows 120 which represent passageways through which cooling air can flow.

It will be appreciated that such passageways 120 allow cooling air to flow from at least some of the chambers defined in the passage 28 by the partitions 90 to 96.

It will be appreciated that, in at least some of the embodiments described above, the partitions 40 to 44, 60 to 68 and 90 to 96 cause the cooling air to change direction during flow through the aperture 26. These changes of direction can serve to separate particulate material, such as dust, from the cooling air flow, causing the particles to adhere to the partitions. Consequently, dust can be prevented from reaching one or more of the gaps nearest the trailing edge of the aerofoil 2. To take account of this, the gaps can be progressively narrowed in the downstream direction. Thus, the wider upstream gaps are sufficiently wide to avoid blockage by dust or sand particles, such particles being trapped by the partitions to prevent them from reaching the narrower downstream gaps where they may cause a risk of blockage.

By constructing components in accordance with the present invention, heat transfer is positioned close to the external surface of the component, where it is required for maximum cooling. Structure is located away from the hot walls 34, 36 for maximum load carrying ability. A cooling arrangement in accordance with the present invention is particularly suitable for achieving high heat transfer levels in the trailing edge region of an aerofoil component without the parasitic weight of conventional pedestals. Because the cooling air is forced by the partitions to undergo a convoluted path generally in the chord-wise direction of the component, the effective passage length of the passage 28 is increased, so increasing the possibility of heat transfer and/or pressure loss.

By adjusting the gap width for the different partitions 40 to 44, 60 to 68 and 90 to 96, it is possible to achieve a desired level and distribution of heat transfer coefficient and pressure loss in the cooling air. By positioning the gaps appropriately, it is possible to achieve a different cooling effect over the pressure and suction sides of the aerofoil 2. By appropriate design of the partitions, the component can be provided with a high second moment of area, enhancing stiffness where the component is a nozzle guide vane or a turbine blade, or other elongated component.

The invention claimed is:

1. An aerofoil component of a gas turbine engine comprising:

oppositely disposed external walls defining an internal passage for conveying cooling fluid, the passage extending from a passage inlet to a passage outlet and comprising a plurality of chambers which are separated from one another by at least one partition, the partition extending internally from one of the external walls towards an internal surface of the opposite external wall and terminates short of the internal surface of the opposite external wall to define a gap through which the cooling fluid passes, the partition having a lateral extension at its end to increase the length of the gap, wherein no internal walls are disposed within the gap.

2. The aerofoil component as claimed in claim 1 wherein the lateral extension projects to one side of the partition.

3. The aerofoil component as claimed in claim 1 wherein the lateral extension projects to both sides of the partition.

4. An aerofoil component of a gas turbine engine comprising:

oppositely disposed external walls defining an internal passage for conveying cooling fluid;

a passage inlet; and a passage exit, the passage extending from the passage inlet to the passage exit and including:

at least one partition extending internally from one of the external walls towards an internal surface of an opposite external wall and terminating short of the internal surface of the opposite wall to define a gap, wherein the partition has a lateral extension at its end to increase the length of the gap;

a plurality of chambers which are separated from one another by the at least one partition, the chambers communicating with each other through the gap, wherein there are at least three chambers and at least two partitions separating the respective chambers from one another.

5. The aerofoil component as claimed in claim 4 wherein at least one of the partitions extends from one of the walls and at least one other of the partitions extends from the opposite wall.

6. The aerofoil component as claimed in claim 1 wherein there are two adjacent partitions which extend from the same wall.

7. The aerofoil component as claimed in claim 1 wherein the width of the gap between one of the partitions and the respective wall differs from the width of the gap between another of the partitions and the respective wall.

8. The aerofoil component as claimed in claim 7 wherein the smaller gap is disposed upstream of the larger gap, with respect to the flow direction from the passage inlet to the passage exit.

9. The aerofoil component as claimed in claim 1 wherein at least one of the walls is provided with an outlet passageway which extends from one of the chambers to the exterior of the component.

10. The aerofoil component as claimed claim 1 wherein the lateral projection and the internal surface of the respective wall are parallel to each other.

11. The aerofoil component as claimed in claim 1 wherein the passage has a serpentine configuration.

12. The aerofoil component as claimed in claim 1 wherein the component is elongate, the chambers also being elongate and extending in the lengthwise direction of the component.

13. The aerofoil component as claimed in claim 1 wherein the chambers extend over substantially the full length of the component.

14. The aerofoil component as claimed in claim 1 wherein the passage outlet comprises outlet passageways opening adjacent to the trailing edge of the component.

15. An aerofoil component of a gas turbine engine comprising:

a first wall having an internal surface;

a second wall having an internal surface and disposed opposite the first wall;

an internal passage defined between the internal surface of each of the walls;

at least one partition extending from the internal surface of the first wall to the internal surface of the second wall to define a plurality of chambers, the partition terminating short of the internal surface of the second wall to define a gap through which cooling fluid passes, and the partition having a lateral extension at its end to increase the length of the gap, wherein no internal walls are disposed within the gap.

16. The aerofoil component as claimed in claim 15 wherein the lateral extension projects to one side of the partition.

17. The aerofoil component as claimed in claim 15 wherein the lateral extension projects to both sides of the partition.

18. An aerofoil component of a gas turbine engine comprising:

oppositely disposed external walls defining an internal passage for conveying cooling fluid, the passage extending from a passage inlet to a passage outlet and comprising a plurality of chambers which are separated from one another by a plurality of partitions, the plurality of partitions extending internally from one of the external walls towards an internal surface of the opposite external wall and terminates short of the internal surface of the opposite external wall to define a plurality of gaps through which the cooling fluid passes, the plurality of partitions having lateral extensions at their ends to increase the length of the plurality of gaps, and the plurality of partitions are configured such that the cooling fluid enters from the passage inlet and flows through each of the plurality of chambers in the component prior to exiting through the passage outlet.

19. An aerofoil component of a gas turbine engine comprising:

a first wall having an internal surface;

a second wall having an internal surface and disposed opposite the first wall;

an internal passage defined between the internal surface of each of the walls and extending from a passage inlet to a passage outlet;

a plurality of partitions extending from the internal surface of the first wall to the internal surface of the second wall to define a plurality of chambers, the plurality of partitions terminating short of the internal surface of the second wall to define a plurality of gaps through which cooling fluid passes, and the plurality of partitions having lateral extensions at their ends to increase the length of the plurality of gaps, wherein the plurality of partitions are configured such that the cooling fluid enters from the passage inlet and flows through each of the plurality of chambers in the component prior to exiting through the passage outlet.

20. The aerofoil component as claimed in claim 18 wherein there are two adjacent partitions which extend from the same wall.

21. The aerofoil component as claimed in claim 18 wherein the passage has a serpentine configuration.

22. The aerofoil component as claimed in claim 19 wherein there are two adjacent partitions which extend from the same wall.

23. The aerofoil component as claimed in claim 19 wherein there are two adjacent partitions which extend from the same wall.

24. An aerofoil component of a gas turbine engine comprising:

oppositely disposed external walls defining an internal passage for conveying cooling fluid, the passage extending from a passage inlet to a passage outlet and comprising a plurality of chambers which are separated from one another by a plurality of partitions, the plurality of partitions extending internally from one of the external walls towards an internal surface of the opposite external wall and terminates short of the internal surface of the opposite external wall to define a gap through which the cooling fluid passes, the partition having a lateral extension at its end to increase the length of the gap, and the plurality of partitions are configured such that the cooling fluid enters from the passage inlet and flows through each of the plurality of gaps in the component prior to exiting through the passage outlet.

25. An aerofoil component of a gas turbine engine comprising:

a first wall having an internal surface;

a second wall having an internal surface and disposed opposite the first wall;

an internal passage defined between the internal surface of each of the walls and extending from a passage inlet to a passage outlet;

a plurality of partitions extending from the internal surface of the first wall to the internal surface of the second wall to define a plurality of chambers, the plurality of partitions terminating short of the internal surface of the second wall to define a gap through which cooling fluid passes, and the plurality of partitions having lateral extensions at their ends to increase the length of the gap, wherein the plurality of partitions are configured such that the cooling fluid enters from the passage inlet and flows through each of the plurality of gaps in the component prior to exiting through the passage outlet.

26. The aerofoil component as claimed in claim 24 wherein there are two adjacent partitions which extend from the same wall.

27. The aerofoil component as claimed in claim 25 wherein the passage has a serpentine configuration.

28. The aerofoil component as claimed in claim 25 wherein there are two adjacent partitions which extend from the same wall.

29. The aerofoil component as claimed in claim 25 wherein there are two adjacent partitions which extend from the same wall.

30. An aerofoil component of a gas turbine engine comprising:

oppositely disposed external walls defining an internal passage for conveying cooling fluid, the passage extending from a passage inlet to a passage outlet and comprising a plurality of chambers which are separated from one another by at least one partition, the partition extending internally from one of the external walls towards an internal surface of the opposite external wall and terminates short of the internal surface of the opposite external wall to define a gap through which the cooling fluid passes, the partition having a lateral extension at its end to increase the length of the gap, wherein the plurality of chambers extend substantially through the entire length of the component.

* * * * *